United States Patent [19]

Buck et al.

[11] Patent Number: 4,900,879

[45] Date of Patent: Feb. 13, 1990

[54] INSULATION SYSTEM FOR MAGNETIC WINDINGS

[75] Inventors: Robert J. Buck, Dover, N.J.; Helmut H. Landeck, Kelsterbach, Fed. Rep. of Germany; Henry J. Luer, Denville, N.J.

[73] Assignee: American Telephone and Telegraph Company, AT&T Bell Laboratories, Murray Hill, N.J.

[21] Appl. No.: 252,961

[22] Filed: Oct. 3, 1988

[51] Int. Cl.[4] ..... H01B 7/02

[52] U.S. Cl. ..... 174/120 R; 428/371; 428/377

[58] Field of Search ..... 174/120 R, 120 AR, 120 SR, 174/110 N, 110 PM; 428/377, 371, 906; 156/52, 53, 56

[56] References Cited

U.S. PATENT DOCUMENTS

| | | | |
|---|---|---|---|
| 240,772 | 4/1881 | Schinneller | 174/120 R |
| 351,191 | 10/1886 | McCracken | 174/120 R |
| 3,033,227 | 5/1962 | Cram et al. | 174/110 PM |
| 3,422,215 | 1/1969 | Humes | 174/120 R |
| 3,488,537 | 1/1970 | Beddows | 174/120 R |
| 3,617,617 | 11/1971 | Katz | 174/120 SR |
| 4,197,348 | 4/1980 | Townsend | 174/120 SR X |

FOREIGN PATENT DOCUMENTS

| | | | |
|---|---|---|---|
| 2120152 | 5/1972 | Fed. Rep. of Germany | 174/120 SR |
| 1255744 | 12/1961 | France | 174/120 R |

*Primary Examiner*—Morris H. Nimmo

*Attorney, Agent, or Firm*—Alfred G. Steinmetz

[57] ABSTRACT

An insulation system and method utilizes multiple helically wound insulating tape windings wound on a wire. Each individual insulating tape winding is wound so that each wrap overlaps a specified area of the preceding wrap of the winding.

7 Claims, 2 Drawing Sheets

INSULATION SYSTEM FOR MAGNETIC WINDINGS

FIELD OF THE INVENTION

This invention relates to wire or conductor insulation systems and in particular to a system and method of insulating the conductors of a winding for use on a magnetic device.

BACKGROUND OF THE INVENTION

Proper insulation is one of the fundamental design considerations in any electrical component. In a multiwinding magnetic component, such as a transformer, proper insulation must be provided between the various windings and between the windings and the magnetic core. Further consideration must be given to providing proper insulation protection to certain critical winding locations such as winding terminations. Not only is such insulation essential to insure proper functioning of the component and any associated circuitry and to provide personal safety, but in most applications of use the component must meet specific Government or Safety Agency promulgated performance and construction requirements.

The insulation system of a small transformer for office machinery typically achieves these requirements by using insulated windings combined with a multiple turn insulating tape wrapping positioned between different windings to achieve several layers of insulation and by using multiple wire sleevings at the terminal ends of the windings. This particular construction insures that multiple layers of insulation, as may be required by government or safety agency requirements, will always appear between the primary and secondary windings. Since coating, spraying, potting and painting of insulation on the wires does not normally meet such agency promulgated safety requirements, the insulation must always comprise a layered film of insulation with the required number of layers between windings being specified differently in different jurisdiction but most often being normally three layers.

These required tape wrapping and sleeving operations constitute a substantial portion of the overall cost of the transformer. Furthermore the complexity of the insulation construction results in a reduction of production yields of acceptable transformers thereby further increasing their cost.

SUMMARY OF THE INVENTION

In one embodiment of the invention, the desired insulation to meet Government or Safety Agency promulgated standards in the construction of a transformer are attained by applying a three layer insulation system directly to the wire of the windings, before it is wound on the bobbin or core, so that the wire insulation by itself has the requisite three layer voltage withstanding characteristic sufficient to meet legal safety requirements and at the same time reduce construction complexity.

The wire is helically wound with two or three overlapping layers of insulating tape, as required, with each of the successive layers of tape overlapping a preceding layer of the tape by a specified amount of overlap. Each successive layer of tape is helically wound with a helical pitch or helical winding angle selected to assure the specified amount of overlap of a preceding winding of the tape. In two layer systems the winding of each tape layer may be helically wound in the same direction, but with oppositely directed pitch or helical angles while in three layer systems the alternate winding of each added layer of tape has a pitch of helical angle directed oppositely from the winding angle of the underlying layer. In each case the tape winding is devised in such a manner so as to provide the required creepage and clearance distance requirements between its conductor surface and its outer insulating surface as required by electrical safety regulations.

BRIEF DESCRIPTION OF THE DRAWING

An understanding of the invention may be readily attained by reference to the following specification and the accompanying drawing in which.

DETAILED DESCRIPTION

Figure 1:
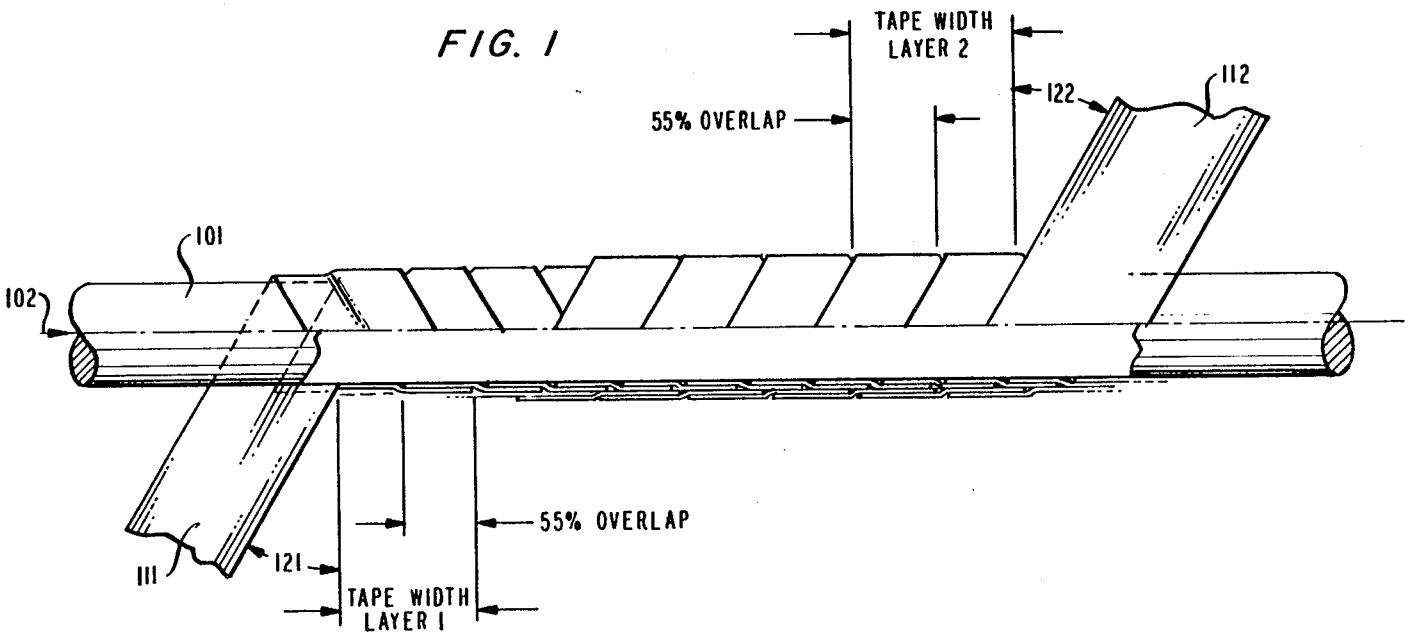
FIG. 1 shows a partial cross section of a wire wound with two layers of insulating tape according to the invention.

A wire 101 partially wrapped with two layers of insulating tape is disclosed in FIG. 1. The wire 101 has a first layer of insulating tape 111 wrapped around it in a helical fashion with a pitch selected to achieve a desired overlap and at a helical angle 121 which gives the desired pitch and which is illustratively shown as approximately 30 degrees and with a handedness of a counter clockwise direction if the wire is looked at in the direction of its longitudinal axis as shown by arrow 102 in FIG. 1. The pitch of successive wrappings of insulative tape 111 is specifically selected so that each turn of the wrap overlaps a previous turn of the same insulating tape on the wire 101 by a specified amount of coverage. In the embodiment of FIG. 1 each wrap of tape 111 covers at least one-half of the width of the previous underlying wrap of the same insulating tape 111.

A second layer of insulating tape 112 is wound about the wire 101 and on top of the first layer of tape 111 in a helical fashion with an oppositely directed pitch selected to achieve a desired overlap and at a helical angle 122 which is illustratively shown as approximately 30 degrees to a line perpendicular to the longitudinal axis of the wire 101 and which is directed in the same rotational direction as the first tape 111. The handedness of the winding of both tapes 111 and 112 is therefore counter clockwise looking along the longitudinal axis in the direction 102. The second tape 112 is identical in width with the width of the first tape 111. The pitch or helical angle is changed to accommodate the increased winding diameter due to prior winding 111 and still maintain the same desired overlap. The pitch or helical angle of the tapes is also determined by the wire size as well as the tape building (i.e. thickness of underlying layers). The width of the tape is selected to provide the creepage and clearance distance required in the jurisdiction of intended application.

Figure 2:
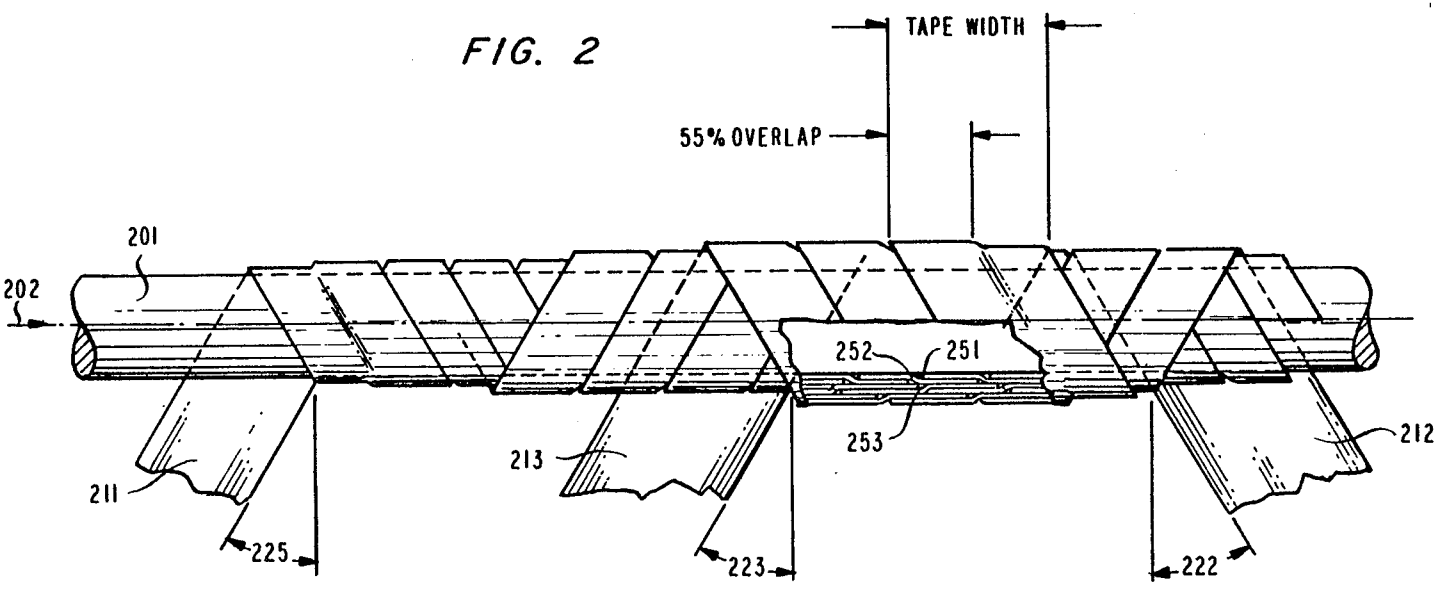
FIG. 2 shows a partial cross section of a wire wound with three layers of insulating tape according to the invention.

A three layer insulative system is shown in FIG. 2 in which a first layer 211, a second layer 212 and a third layer 213 are successively wound on a wire 201 to provide three layers of insulation. A first tape layer 211 is wound in a counterclockwise direction around the wire 201 as looking in the direction 202. It is wound with a pitch or at a helix angle 225 selected to assure that each successive wrap of the tape 211 overlaps at least one-half of the area of a previous wrap of tape 211.

A second layer of tape 212 is wound on top of the layer of tape 211 with the pitch or helical angle in the opposite direction from that of tape 211. This second layer of tape is also wound with a pitch or at a helix angle 222 selected so that each successive wrap of the tape 222 overlaps at least one-half of the area of a previous wrap of tapes 222.

The addition of a third insulating tape 213 to the wire 201 is shown wherein the third insulative tape layer 213 is wound on top of the first two previously wound tape layers comprising tapes 211 and 212. It is wound with a pitch or helical angle directed the same at the first winding 211 in a counter clockwise direction as viewed in the direction 202 along the longitudinal axis of the wire 201. Tape 213 is wound with a pitch or at a helical angle 223 so as to maintain a desired overlap of at least one-half of the previous turn of the tape. The pitch or helical angle of successive wraps is changed to maintain the desired overlap. Upon completion of the wrapping of the wire with the three layers of tape it is desirable to sinter the wire wrappings to bond them into a single entity.

An important consequence of this winding technique is that each and every point on wire 201 is insulated from the outside by three unbroken layers of insulation even where the edge of a particular insulating tape occurs. For example the voids 251, 252 and 253 occurring near each other are still insulated from the outside by at least three unbroken layers of insulation. This triple layered insulation assures that three layers of film insulation separate the wire 201 from any other entity associated with it.

A typical application of such triple tape wound film insulated wire is in transformer structures in which primary and secondary windings must be triple insulated from each other and the ends of windings and terminal ends must be normally multiply sleeved if traditional methods of insulation are used.

I claim:

1. In combination:

a wire;

an insulation system with predefined creepage and clearance distances for the wire, comprising:

a first insulating tape helically would about and contiguous to the wire with a pitch in a first direction selected such that each successive turn of the first insulative tape overlaps a portion of a previous turn of the first insulative tape by a first width equalling at least one half of a width of the first insulative tape, a second insulating tape helically wound about the wire and on top of the first insulative tape with a pitch in a second direction such that each successive turn overlaps a previous turn of the second insulative tape by a second width equalling at least one half of a width of the second insulative tape, and a third insulating tape helically wound about the wire and on top of the second insulative tape with a pitch in the first direction such that each successive turn overlaps a previous turn of the third insulative tape by a third width equalling at least one half of a width of the third insulative tape, the first, second and third insulating tapes being of a common material and the first, second and third width being sufficient in summation for attaining the predefined creepage and clearance distances.

2. The combination as defined in claim 1 wherein the first, second and third insulating tapes have identical widths and are alternately wound on the wire with an oppositely directed pitch.

3. The combination as defined in claim 1 wherein a helical angle of wrapping is identical for the first and third insulating tapes, and an oppositely directed helical angle of wrapping is used for the second insulting tape.

4. The combination as defined in claim 2 or 3 wherein winding is such that an overlap dimension for each the first, second and third insulative tapes is an identical percentage of each tape width.

5. A method of insulating a wire comprising the steps of:

defining a desired creepage and clearance distance:

selecting the first, second and third width amounts to obtain the desired creepage and clearance distance;

winding a first insulative tape of an insulative material helically around the wire so that successive wraps of the first insulative tape overlap a previous wrap of the first insulative tape by a first width amount substantially equaling at least one-half of a width of the first insulative tape;

winding a second insulative tape of the insulative material helically around the wire on top of the first insulative wrapped on the wire so that successive wraps of the second insulative tape overlap a previous wrap of the second insulative tape by a second width amount substantially equaling at least one-half of a width of the second insulaive tape winding a third insulative tape of the insulative material helically wound the wire on top of the second insulative wrapped on the wire so that successive wraps of the third insulative tape overlap a previous wrap of the third insulative tape by a third width amount substantially equaling at least one-half of a width of the third insulation tape.

6. A method of insulating a wire is claimed in claim 5 and further comprising the steps of:

sintering wire wrappings at completion of winding the first, second and third layer to bond them into a single entity.

7. A method of insulating a wire as claimed in claim 6 and further comprising the steps of:

winding the first layer of tape at a pitch angle oriented in a first direction;

winding the second layer of tape at a pitch angle oriented in a second direction opposite the first rotational direction; and winding the third layer of tape with the pitch angle oriented in the first direction.

* * * * *